US008371477B2

(12) United States Patent
Klopfenstein et al.

(10) Patent No.: US 8,371,477 B2
(45) Date of Patent: Feb. 12, 2013

(54) DEVICE FOR DISPENSING A BEVERAGE WITH A CONTROLLED AIR INLET, AND METHOD THEREOF

(75) Inventors: Andre Klopfenstein, La Neuveville (CH); Elmar Mock, Colombier (CH); Christoph Rusch, Biel (CH); Naomi Bitmead, Niederwangen b. Bern (CH)

(73) Assignee: Nestec S.A., Vevey (CH)

( * ) Notice: Subject to any disclaimer, the term of this patent is extended or adjusted under 35 U.S.C. 154(b) by 1216 days.

(21) Appl. No.: 12/160,276

(22) PCT Filed: Jan. 5, 2007

(86) PCT No.: PCT/EP2007/050105

§ 371 (c)(1),
(2), (4) Date: Jul. 30, 2008

(87) PCT Pub. No.: WO2007/080150

PCT Pub. Date: Jul. 19, 2007

(65) Prior Publication Data

US 2009/0145926 A1 Jun. 11, 2009

(30) Foreign Application Priority Data

Jan. 9, 2006 (EP) ..... 06000320

(51) Int. Cl.
*B67D 7/74* (2010.01)

(52) U.S. Cl. ..... 222/129.4; 222/52; 222/63; 222/145.5; 222/383.1; 222/383.2; 222/481.5

(58) Field of Classification Search .... 222/129.1–129.4, 222/133, 135–136, 1, 145.5, 145.6, 504, 222/383.1, 333, 383.2, 52, 63, 481.5, 481, 222/282

See application file for complete search history.

(56) References Cited

U.S. PATENT DOCUMENTS

| | | | | |
|---|---|---|---|---|
| 2,939,611 | A | 6/1960 | Nebinger | |
| 3,994,423 | A * | 11/1976 | Burg | 222/420 |
| 4,096,971 | A | 6/1978 | Kuckens et al. | |
| 4,194,650 | A * | 3/1980 | Nottke et al. | 222/57 |

(Continued)

FOREIGN PATENT DOCUMENTS

| | | |
|---|---|---|
| EP | 0159259 | 10/1985 |
| WO | 9211082 | 7/1992 |

(Continued)

OTHER PUBLICATIONS

European Search Report (PCT/EP2007/050105) mailed on Jun. 1, 2007.

(Continued)

*Primary Examiner* — Frederick C. Nicolas
(74) *Attorney, Agent, or Firm* — K&L Gates LLP

(57) ABSTRACT

A device (3) for metering a base liquid and mixing this base liquid with a diluent to prepare a food product, has a connecting portion for connecting it with a container (4) containing the base liquid, the device (3) including: a diluent inlet (71), a mixing chamber (80) for mixing the base liquid with the diluent. An actively controlled air inlet is provided for selectively having ambient air enter the device and guiding it to the container (4). A controller is provided for selectively metering the base liquid into the mixing chamber and for selectively enabling an air flow through the air inlet only during periods when no base liquid is metered into the mixing chamber.

8 Claims, 15 Drawing Sheets

U.S. PATENT DOCUMENTS

| | | | | |
|---|---|---|---|---|
| 4,247,018 | A * | 1/1981 | Credle | 222/1 |
| 4,364,493 | A | 12/1982 | Raynes et al. | |
| 5,133,482 | A * | 7/1992 | Burrows et al. | 222/185.1 |
| 5,154,319 | A * | 10/1992 | Deininger et al. | 222/105 |
| 5,156,301 | A * | 10/1992 | Hassell et al. | 222/129.2 |
| 5,305,923 | A | 4/1994 | Kirschner et al. | |
| 5,615,801 | A | 4/1997 | Schroeder et al. | |
| 5,842,603 | A | 12/1998 | Schroeder et al. | |
| 6,092,693 | A | 7/2000 | Powell | |
| 6,223,791 | B1 | 5/2001 | Arsenault et al. | |
| 6,568,565 | B1 | 5/2003 | Schroeder et al. | |
| 6,662,976 | B2 * | 12/2003 | Jensen et al. | 222/481.5 |
| 2001/0004081 | A1 | 6/2001 | Tansley et al. | |
| 2007/0272317 | A1 * | 11/2007 | Klopfenstein et al. | 137/889 |

FOREIGN PATENT DOCUMENTS

| | | |
|---|---|---|
| WO | 0121292 | 3/2001 |

OTHER PUBLICATIONS

Written Opinion of International Searching Authority mailed on Jun. 1, 2007.

* cited by examiner

DEVICE FOR DISPENSING A BEVERAGE WITH A CONTROLLED AIR INLET, AND METHOD THEREOF

The present invention relates to the dispensing of a liquid from a container. More particularly, the invention relates to the preparation and delivery of drinks, or other liquid food products, by dispensing a food liquid from at least one container and optionally mixing it with at least one diluent.

The invention finds an application e.g. in the delivery of liquid comestibles (e.g. soups) and drinks, with or without froth, hot or cold, from a liquid concentrate and water, hygienically, easily and quickly, even when the volumes delivered are large.

In conventional drinks dispensers, the drinks are reconstituted from a liquid concentrate or powder contained in reservoirs. The liquid concentrate or the powder is metered then mixed with a diluent, generally hot or cold water, inside the dispenser, passing through pipes, pumps and mixing bowls. Mixing is generally performed by a mechanical stirrer contained within a chamber. The conventional preparation of these drinks therefore requires a great deal of maintenance and cleaning in order to keep those parts that are in contact with the food product constantly clean and avoid the risks of contamination and bacterial growth. The machines also represent a significant investment on the part of the operators. Finally, these machines lack versatility in terms of the choice of drinks delivered, even though the current trend is to extend the choice of hot, cold, frothy or non-frothy drinks.

Systems do exist for delivering fruit juices from a disposable or recyclable package containing concentrate and incorporating a pump operated by a dispensing device external to the package. Such a system is described, for example, in U.S. Pat. No. 5,615,801.

Similar devices are described in U.S. Pat. No. 5,305,923 and U.S. Pat. No. 5,842,603, which have the same disadvantages as the patent already discussed.

U.S. Pat. No. 6,568,565 relates to a method and a device for delivering a drink from a concentrate contained in a disposable multi-portion container.

WO 01/21292 relates to a method and device for production of a beverage wherein concentrate is brought to a joining zone in a mixing chamber; in which joining zone the concentrate is brought together with a diluent.

When metering a liquid from a closed container the problem occurs that the filling level of the container for the liquid is successively reduced. In turn either the pressure in the container will be reduced (thus creating a vacuum) and/or, in case the walls of the container are somewhat flexible, the container itself will be deformed ("shrink"). Both effects are detrimental to a proper dispensing operation under controlled conditions.

The invention targets at an improved dispensing operation when dispensing a liquid from at least one container.

According to the solution of the invention the volume lost by metering the base liquid from a container is compensated by a controlled flow of air into the container.

The compensation of the volume lost by metering the liquid from the container by introducing a compensatory air volume is also called "venting" in the framework of the present invention.

This object is achieved by means of the features of the independent claims. The dependent claims develop further the central idea of the present invention.

In a first aspect, the invention relates to a device for dispensing a liquid from a container, the device comprising:

an inlet for the liquid from at least one container, and a liquid outlet, wherein control means are provided which are designed to control the draining of liquid from at least one of the containers to the liquid outlet, and control the flow of air into at least one of the containers during periods in which no liquid is allowed to leave the container and flow through the liquid outlet.

A second aspect of the invention relates to a device for dispensing a liquid from a container, the device comprising:

an inlet for the liquid from at least one container, at least one rotary metering means, a dispensing outlet, wherein control means are provided which are designed to control the flow of liquid from at least one of the containers to the dispensing outlet by controlling the operation of at least one rotary metering means, and control a compensatory flow of air into at least one container.

According to the invention, before leaving the device at the dispensing outlet, the liquid (being a base liquid) can be mixed with at least one diluent in a mixing chamber of the dispensing device, the diluent also being introduced into the mixing chamber.

The device can comprise a cap comprising two half-shells assembled one another and configured to encompass the pump means and valve means and to define the contour of the mixing chamber.

The valve can comprise an actuating part which is positioned to protrude outside of one of said half-shells.

The pump means can comprise a connecting part which is positioned to protrude outside of one of said half shells.

The actuating part of the valve and connecting part of the pump means can be positioned on the same half shell.

The device can comprise at least one referential support means intended for the removable connection of said cap to a docking station of the device.

The docking station can comprise:

an electrical motor, a driveshaft and a drive connector designed to removably connect to the connecting part of the pump means, an actuator configured to selectively engage the actuating part of the valve, at least one guiding means that is complementarily engaging the guiding means of the cap.

The control means can be designed to control the flow of air into the container to start at or, just after, or just before the stop of the controlled metering of a number of predetermined doses of liquid from the container through the liquid outlet.

The control means can be designed to control the flow of air into the container to start at or, just after, or just before the stop of the controlled metering of a single predetermined dose of liquid from the container through the liquid outlet.

In another aspect, the invention relates to a device for preparing a diluted mixture by mixing at least two nutritional liquids, the liquids being supplied from distinct compartments of a container or distinct containers, the device comprising at least two liquid metering means and two metering ducts for respectively metering the two liquids to a mixing chamber in which the liquids mix together. At least one diluent duct is positioned in a manner to intersect with one of the liquid ducts. An air inlet is also provided to provide air in the mixture.

The term "nutritional" includes any edible liquid such as food or beverage concentrate, aroma, flavours, nutritional supplement, and/or additives.

Still further aspects of the invention relate to methods for dispensing a liquid from at least one container.

The characteristics and advantages of the invention will be better understood in relation to the figures which follow:

Figure 15:
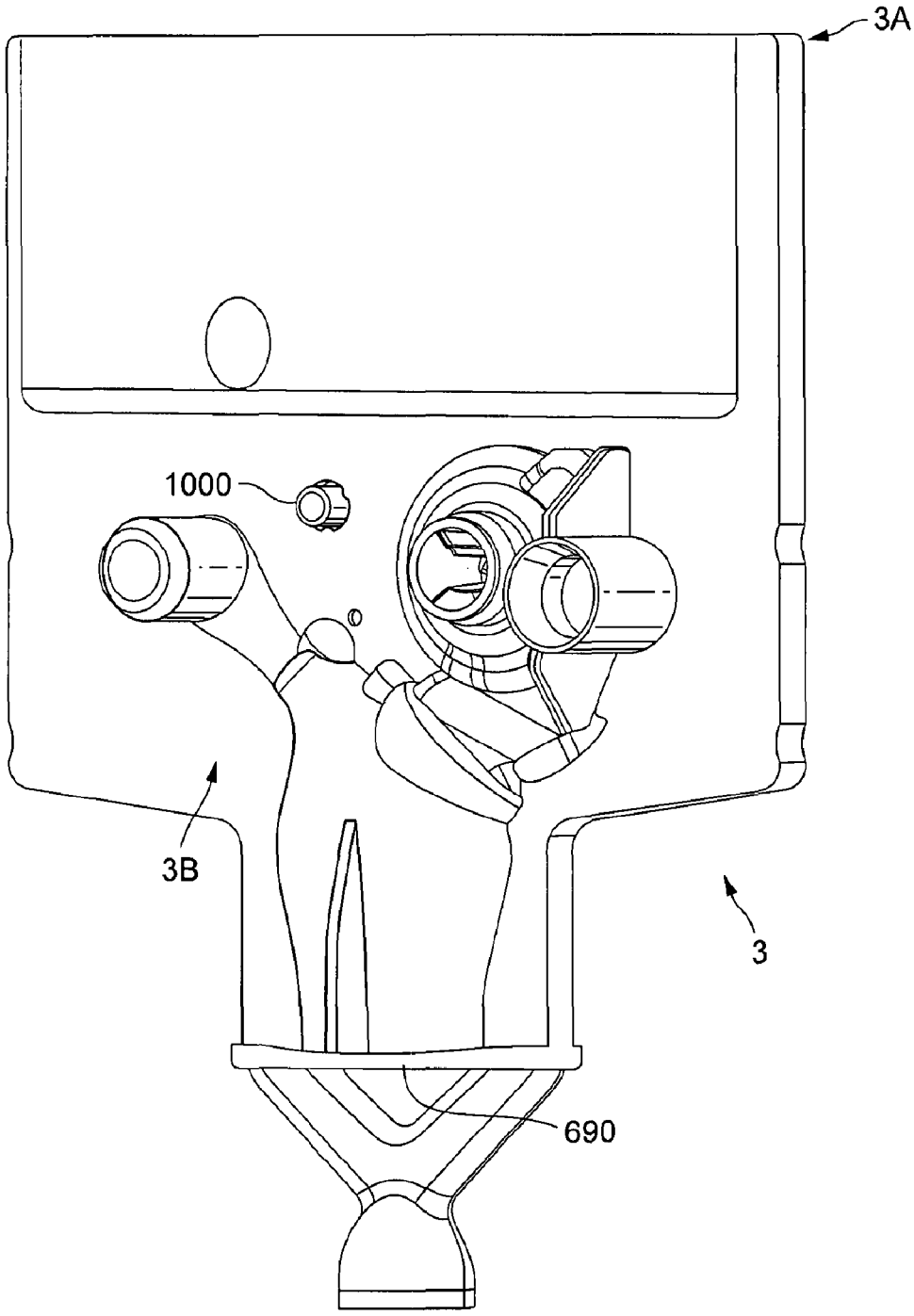
Figure 16:
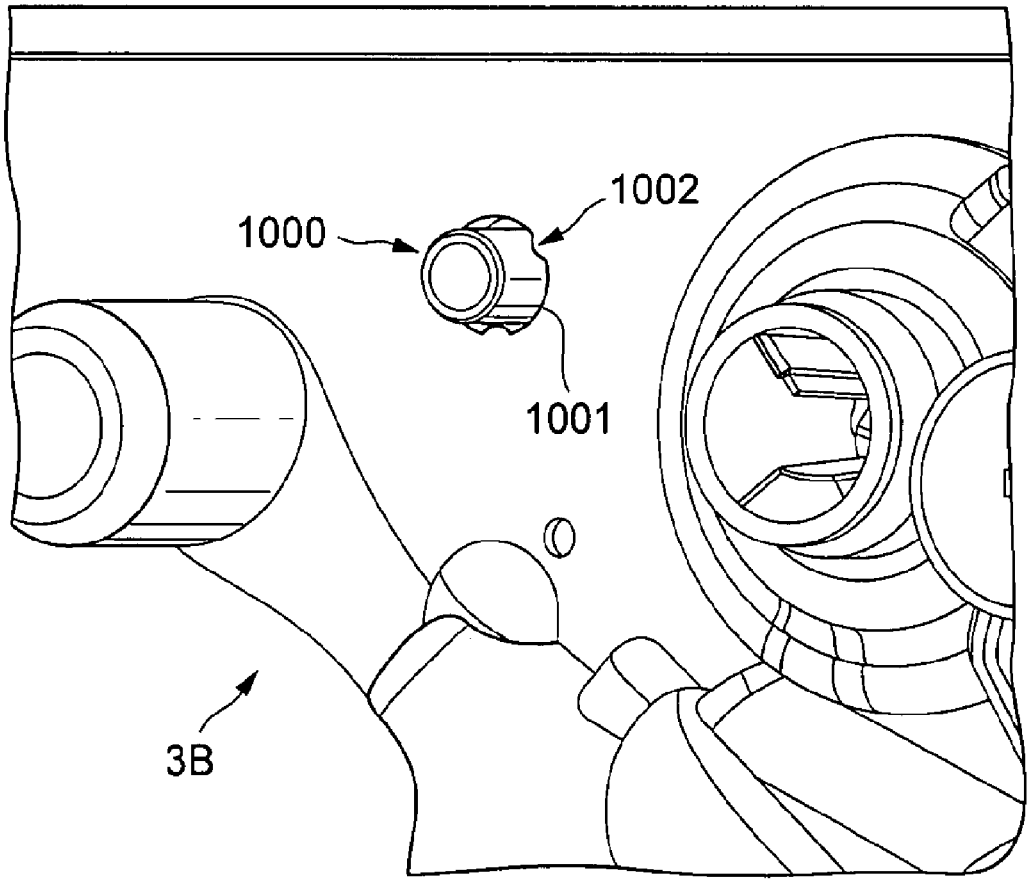
Figure 17:
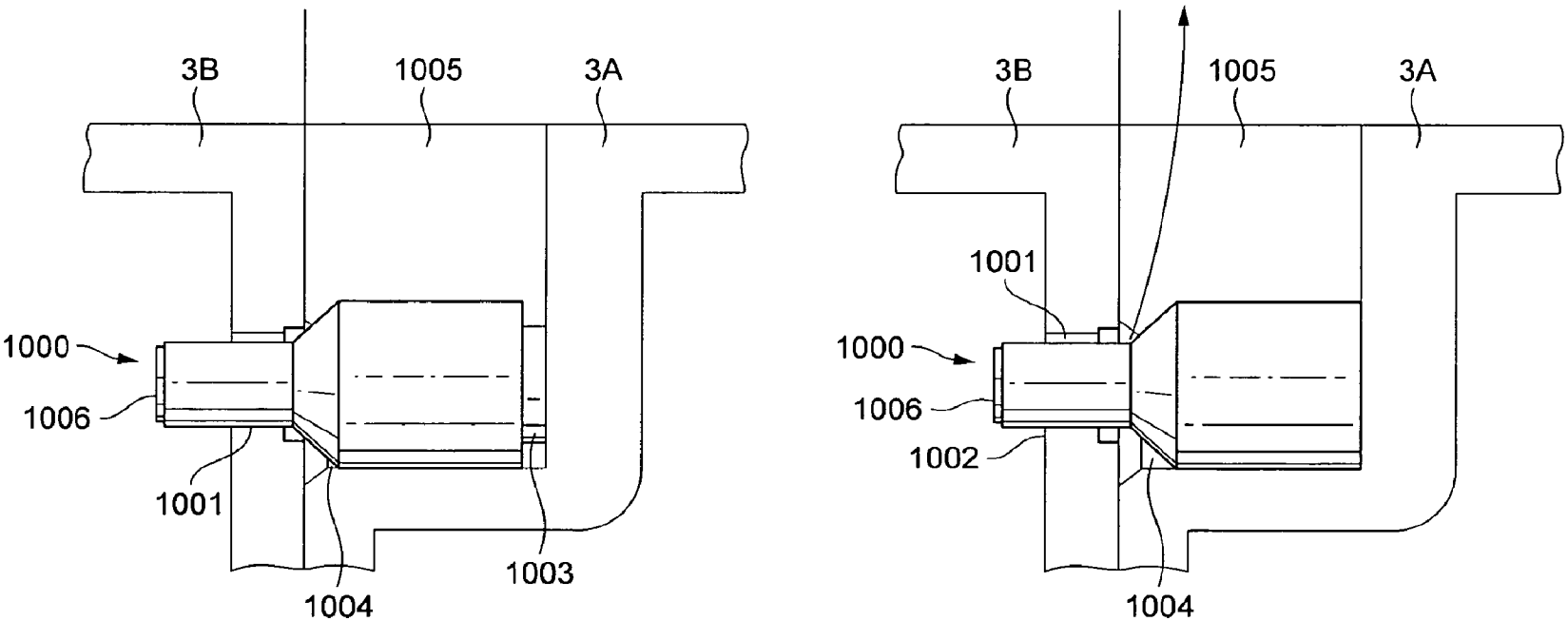
Figure 18:
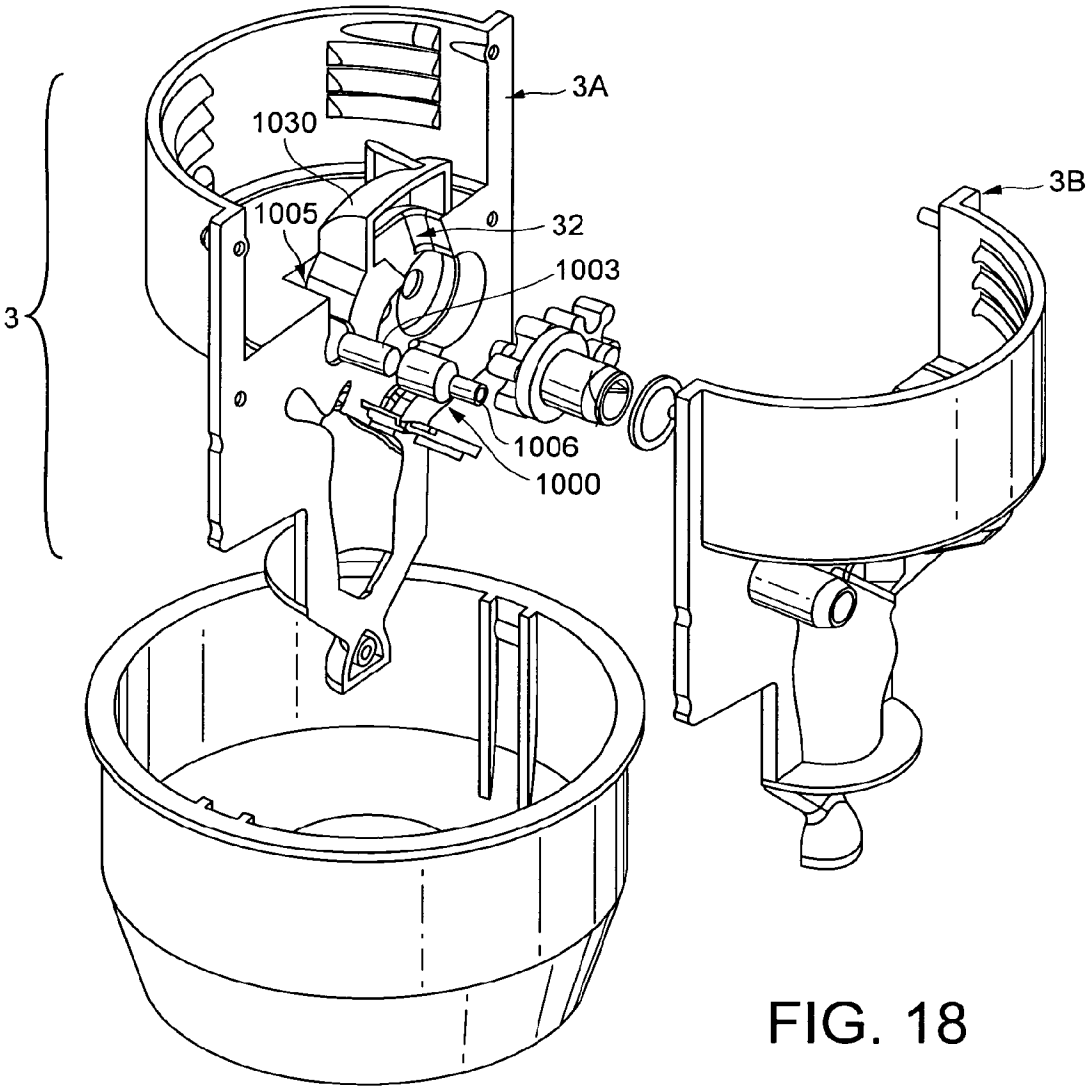
Figure 19:
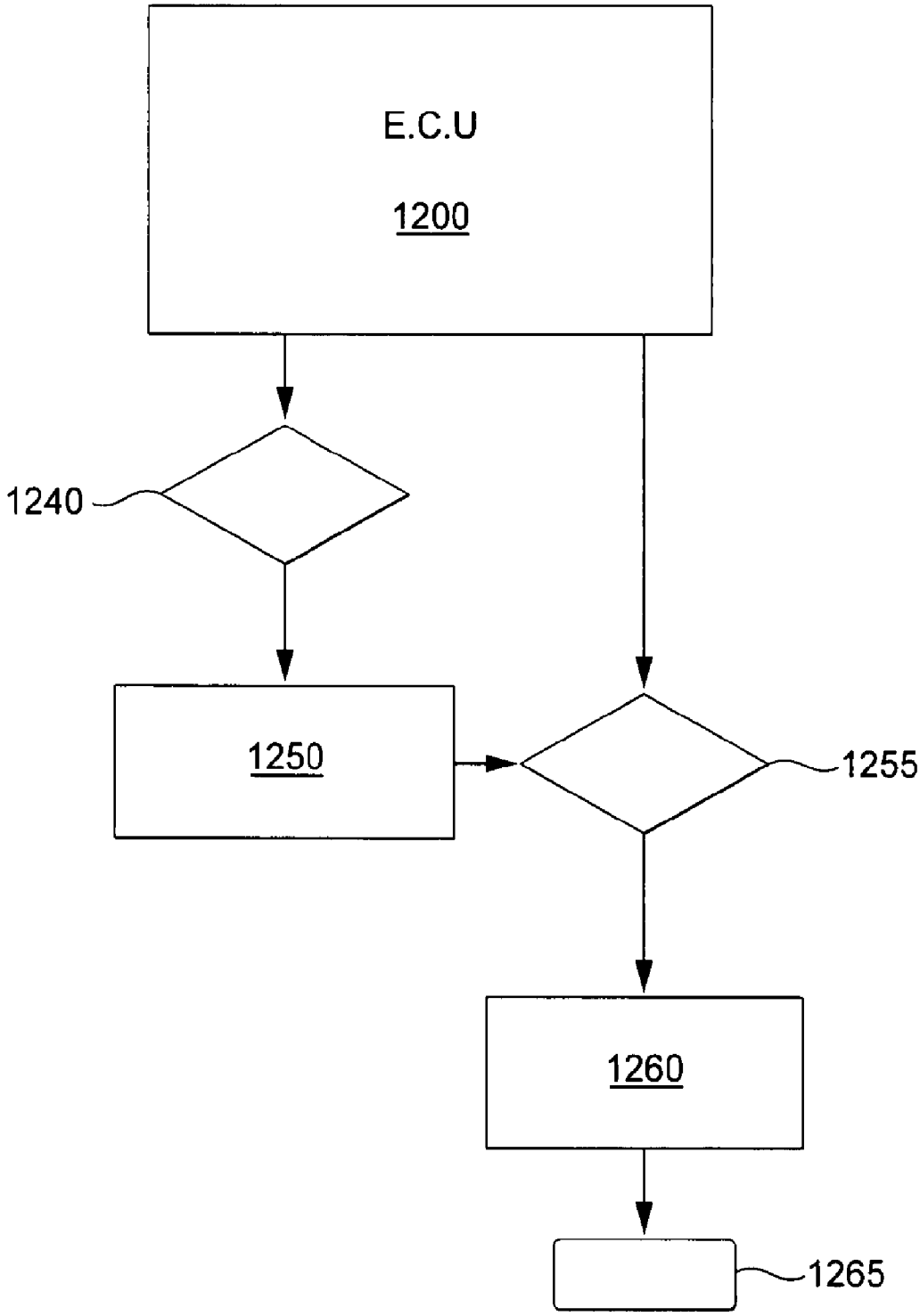
Figure 20:
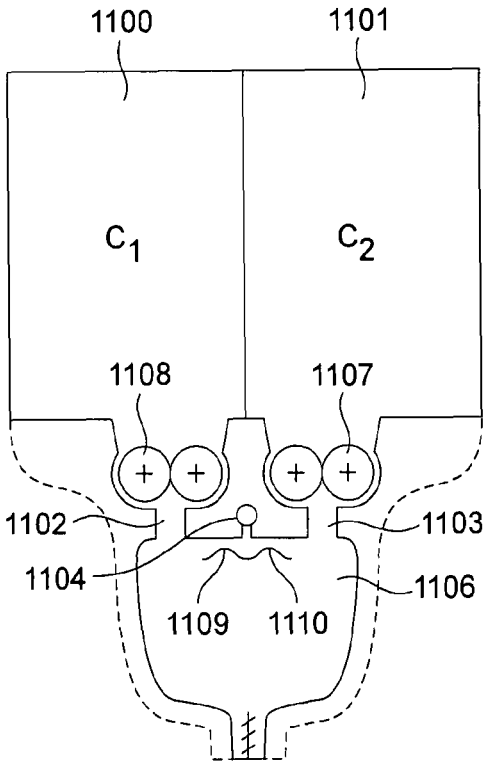
Figure 21:
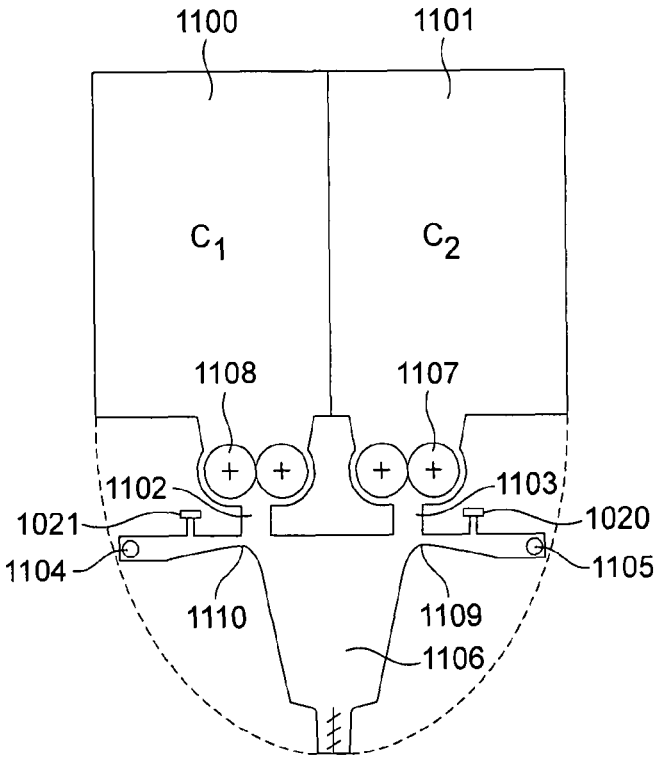

FIG. 15 shows a view of a venting arrangement according to the present invention, FIG. 16 shows a detained view of a venting arrangement of the present invention, FIG. 17 shows a sectional view of a venting device according to the present invention, FIG. 18 shows an exploded view of a cap according to an embodiment of the invention, FIG. 19 shows flow chart for an example of the control of the venting and dosing process of the invention, and FIGS. 20 and 21 illustrate embodiments having a plurality of containers and/or rotary metering devices.

DETAILED DESCRIPTION OF THE FIGURES

Figure 1:
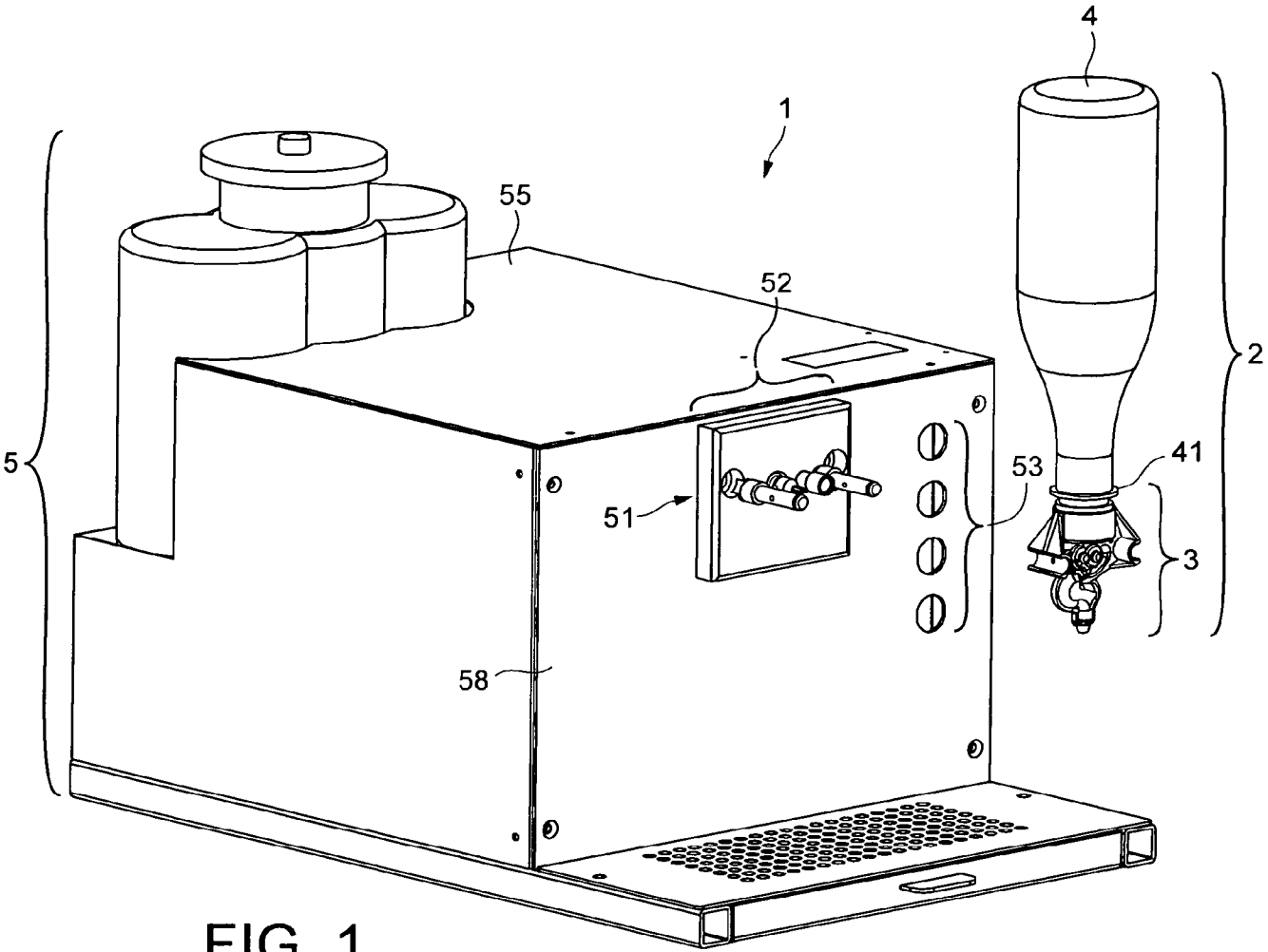
FIG. 1 depicts an overall perspective view of the preparation system comprising a multi-portion package in a position separate from the base station.
Figure 2:
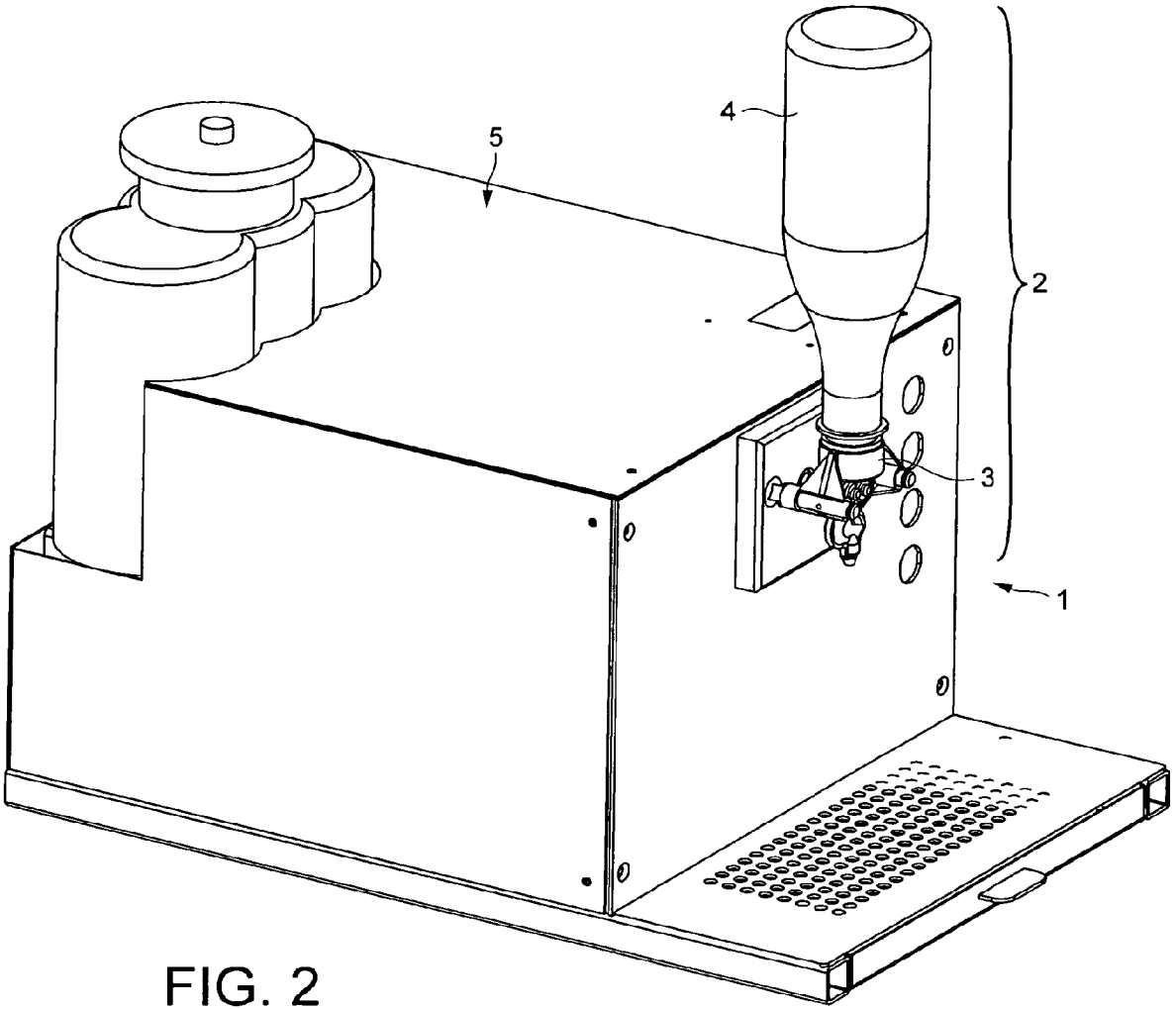
FIG. 2 depicts an overall perspective view of the system of FIG. 1 with the multi-portion package in a docked position against the base station.
Figure 3:
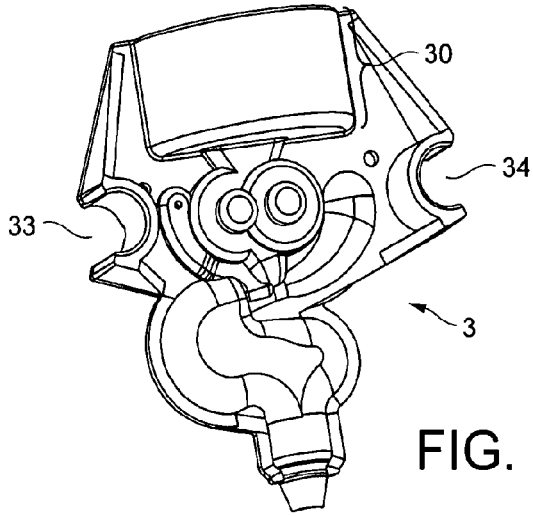
FIG. 3 depicts a view of the front half-shell of the metering and mixing device according to the invention.
Figure 4:
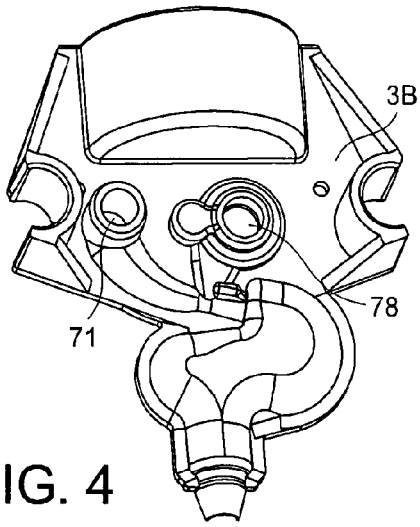
FIG. 4 depicts a view of the rear half-shell of the metering and mixing device according to the invention.
Figure 5:
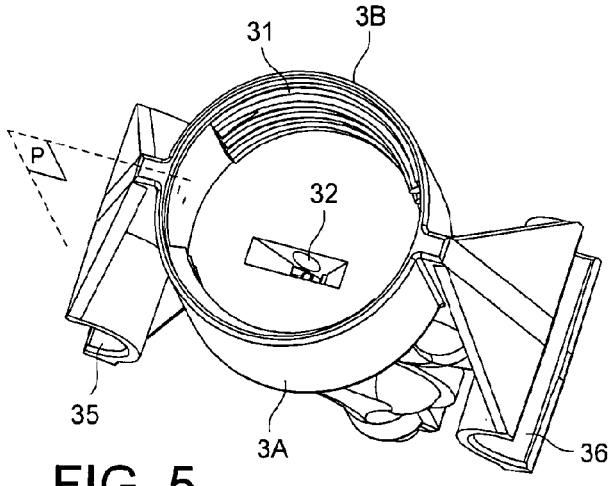
FIG. 5 depicts a view from above of the device of FIGS. 3 and 4.
Figure 6:
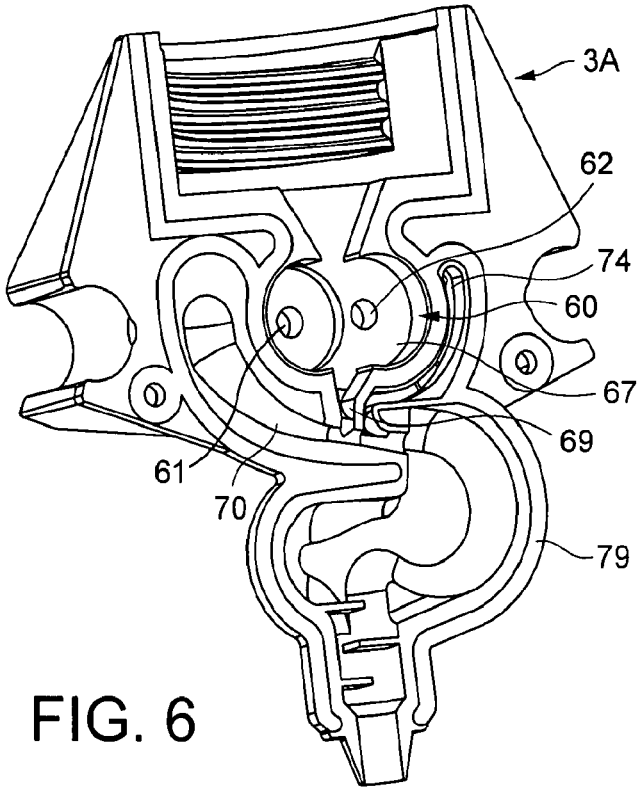
FIG. 6 depicts an internal view of the frontal half-shell of the device of FIGS. 3 to 5, without the gear elements.
Figure 7:
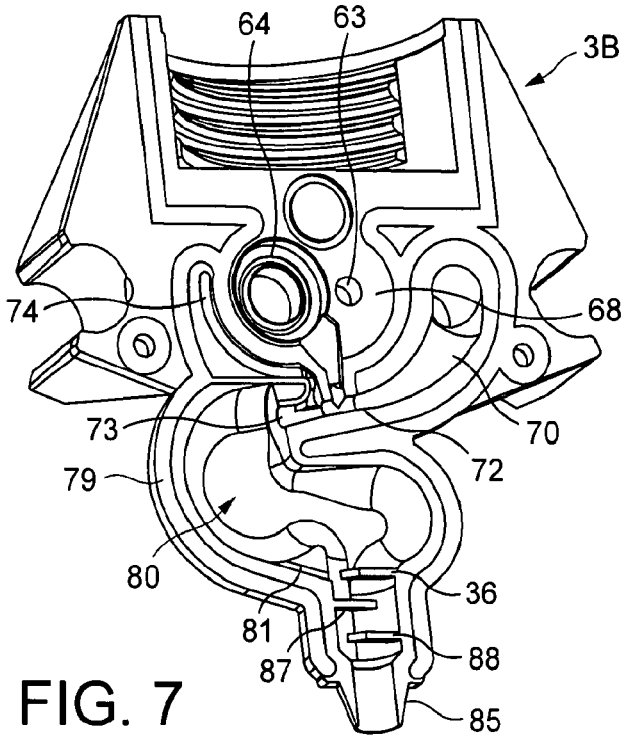
FIG. 7 depicts an internal view of the rear half-shell of the device of FIGS. 3 to 5.

FIGS. 1 and 2 illustrate an overall view of one example of a system for reconstituting and delivering food preparations according to the invention, in particular, of a system for preparing hot or cold drinks 1.

The system comprises, on the one hand, at least one functional package 2 formed of a metering and mixing device 3 and of a container 4 and, on the other hand, a base station 5 which serves to anchor the functional package 2 with a view to preparing and delivering the drinks through the metering and mixing device 3. The device 3 is connected to a container 4 which may be of any kind, such as a bottle, a brick, a sachet, a pouch or the like. The container contains a food liquid intended to be diluted with a diluent, generally hot, ambient-temperature or chilled, water, supplied to the metering device 3 via the base station 5. The liquid may be a concentrate of coffee, a whitener (e.g., milk concentrate), a concentrate of cocoa, fruit juice or a mixture such as a preparation based on coffee concentrate, an emulsifier, flavourings, sugar or artificial sweetener, preservatives and other components.

The liquid may comprise a purely liquid phase with, possibly, solid or pasty inclusions such as grains of sugar, nuts, fruit or the like. The liquid is preferably designed to be stable at ambient temperature for several days, several weeks or even several months. The water activity of the concentrate is thus usually set to a value that allows it to keep at ambient temperature for the desired length of time.

The metering and mixing device 3 and the container 4 are preferably designed to be disposed of or recycled once the container has been emptied of its contents. The container is held in an inverted position, its opening facing downwards and its bottom facing upwards, so as to constantly supply the metering and mixing device 3, particularly the liquid metering pump contained therein, with liquid under gravity. The container 4 and the device 3 are connected by connecting means which may be detachable or permanent as the case may be. It is, however, preferable to provide permanent-connection means in order to avoid excessively prolonged use of the metering and mixing device which, without cleaning after an excessively lengthy period of activity, could end up posing hygiene problems. A permanent connection therefore forces the replacement of the entire package 2 once the container has been emptied, or even before this if the device remains unused for too long and if a hygiene risk exists. However, the inside of the device 3 is also designed to be able to be cleaned and/or rinsed out with diluent, at high temperature for example regularly, for example during rinsing cycles that are programmed or manually activated and controlled from the base station 5.

FIGS. 3 to 9 show the metering and mixing device 3 of the invention in detail according to a preferred embodiment. The device 3 is preferably in the form of a cap which closes the opening of the container in a sealed manner when the container is in the inverted position with its opening facing downwards. The cap has a tubular connecting portion 30 equipped with connecting means such as an internal screw thread 31 complementing connecting means 41 belonging to the container, also of the screw thread type for example. Inside the connecting portion there is an end surface and an inlet 32 situated through this end surface, for liquid to enter the device. It should be noted that the inverted position of the container is justified only if the container has an air inlet for equalizing the pressures in the container and does not therefore contract as it empties. If the opposite is true, such as in the case of a bag which contracts without air, the liquid can be metered when the container is in a position which is not necessarily the inverted one with the cap.

The device 3 is preferably made up, amongst other things, of two half-shells 3A, 3B assembled with one another along a parting line P running more or less in the longitudinal direction of the ducts, particularly of the liquid duct and of the mixing chamber, circulating within the device. The construction in the form of two half-shells, namely a frontal part 3A and a rear other part 3B, makes it possible to simplify the device while at the same time defining the succession of ducts and chambers needed for metering, mixing, possibly frothing, and delivering the mixture.

When the container is one that cannot contract, it is necessary to provide an air inlet into the container in order to compensate for the withdrawal of the liquid. Such an inlet may be provided either through the container itself, such as an opening in the bottom of the container, once this container is in the inverted position, or alternatively at least one air channel through the tubular connecting portion 30 of the device which communicates with the inlet to the container.

Figure 8:
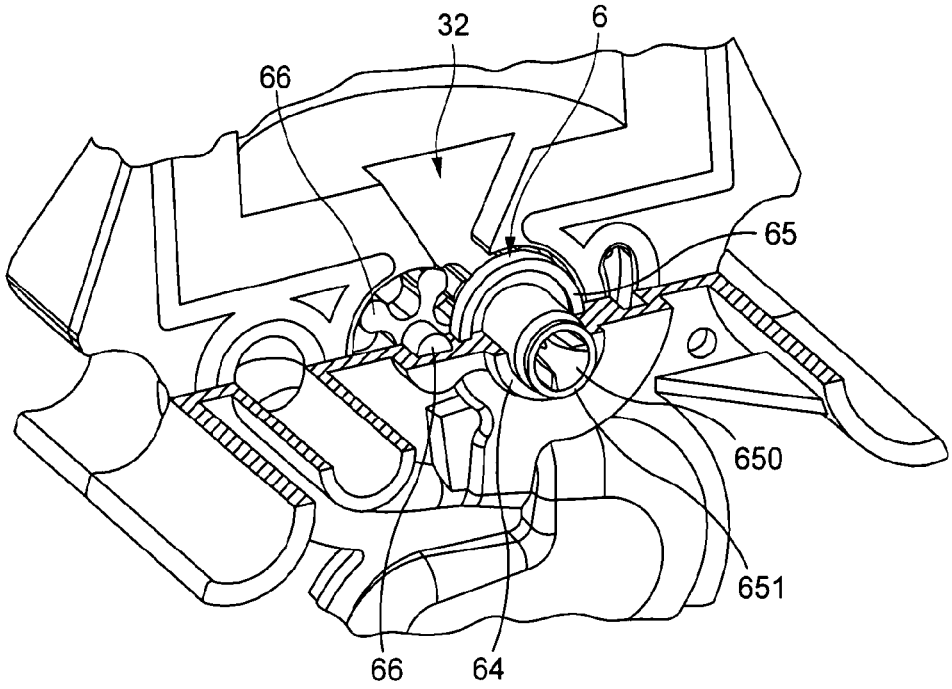
FIG. 8 depicts a detailed view in part section of the pump of the device of FIGS. 3 to 7.
Figure 10:
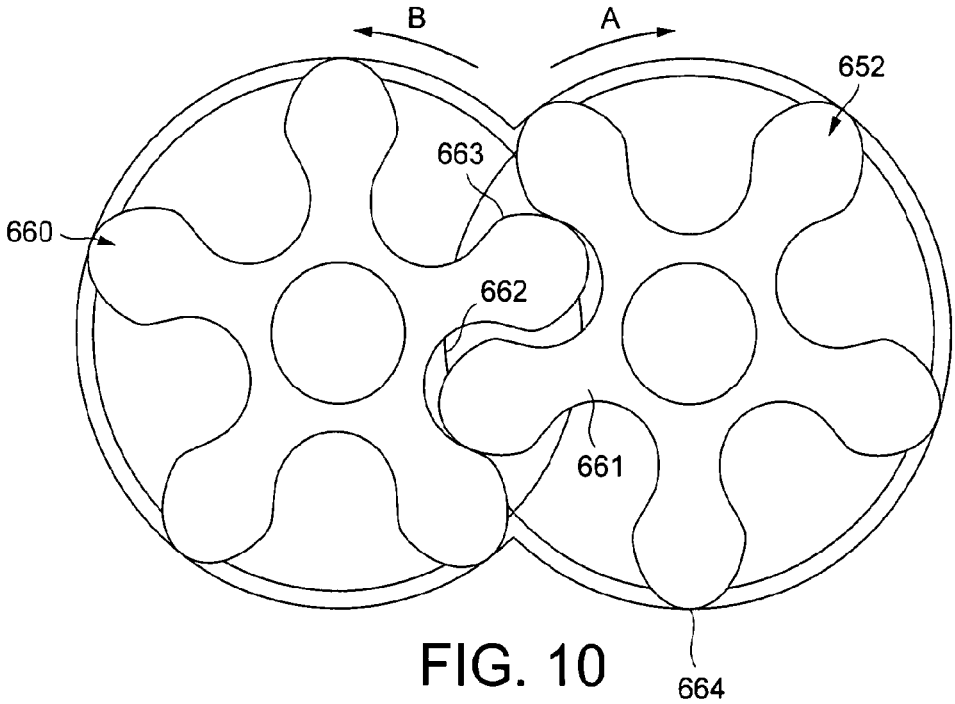
FIG. 10 depicts a schematic front view of the rotary elements in a given geared configuration.

The basic principle of the metering and mixing device 3 will now be described in detail. The device comprises a built-in metering pump 6 for metering the liquid passing through the opening 32. The pump is preferably a gear pump defined by a chamber 60 equipped with bearings 61, 62, 63, 64 present at the bottom of each lateral surface 67, 68 of the chamber and able to guide two rotary elements 65, 66 cooperating in a geared fashion in order to form the moving metering elements of the pump in the chamber. The rotary element 65 is a "master" element equipped with a shaft 650 associated with a coupling means 651 able to engage with a complementary coupling means belonging to the base station 5 (described later on). A lip seal is preferably incorporated between the bearing 64 and the shaft 650 to seal the pump chamber with respect to the outside. The internal pressure when the pump is in motion helps with maintaining sealing by stressing the seal. The rotary element 66 is the "slave" element which is driven in the opposite direction of rotation by the master element. The rotary metering elements 65, 66 are driven in directions A, B as illustrated in FIGS. 8 and 10 in order to be able to meter the liquid through the chamber. The construction in the form of half-shells is such that the chamber is defined by the assembly of the two parts 3A, 3B. The chamber 60 may thus be defined as a hollow in the frontal part 3A with a bottom surface 67 defining one of the lateral surfaces. The other part encloses the chamber via a more or less flat surface portion 68, for example, comprising the bearing 64 that supports the drive shaft 650, which is extended backwards through a passage 78 through the shell part 3B.

The liquid is thus metered through a liquid outlet duct 69 forming a reduction in section. The diameter is of the order of 0.2 to 4 mm, preferably 0.5 to 2 mm. The duct 69 allows fine control over the flow rate of liquid leaving the pump and makes it possible to form a relatively narrow flow of liquid, thus encouraging fine metering.

The device comprises a duct 70 for supplying with diluent which intersects the liquid duct 69. The diluent is conveyed into the device through a diluent intake 71 located through the rear part 3B of the cap. This intake has the form of a connecting tube able to be forcibly fitted with sealing into a tubular coupling and diluent-supply part located on the base station 5. The diluent flow rate is controlled by a diluent pump situated in the base station 5. The diluent duct 70 ends in a restriction 72 beginning just upstream of the point where the liquid and diluent ducts 69, 70 meet and extending at least as far as that point and preferably beyond the meeting point. The restriction makes it possible to accelerate the diluent and this, using a venturi phenomenon, causes a pressure at the meeting point that is lower than or equal to the pressure of the liquid in the liquid outlet duct 69. When the pump is switched off, this equilibrium or differential of pressures, ensures that the diluent crosses the metering point and travels as far as the chamber without rising back up inside the liquid duct. The liquid pump stops while the diluent continues to pass through the device, for example towards the end of the drink preparation cycle in order to obtain the desired dilution of drink. Likewise, the diluent is used to regularly rinse the device. Thus the liquid, for example a coffee or cocoa concentrate, is prevented from being contaminated in the container or the pump by diluent being sucked back through the duct 69.

The restriction is thus sized to create a slight depression at the meeting point. However, the depression needs to be controlled so that it does not excessively lower the boiling point and cause the diluent to boil in the duct when hot drinks are being prepared.

For preference, the restriction has a diameter of between 0.2 and 5 mm, more preferably between 0.5 and 2 mm.

After the meeting point, one and the same duct 73 transports the fluids. A widening of the duct is preferably designed to reduce the pressure drop and take account of the increase in volume of the fluids which combine once they have met at the meeting point. The widened duct 73 is extended into a mixing chamber 80 proper, in which the product is homogeneously mixed.

Of course, the duct portion 73 and the chamber 80 could form one and the same duct or one and the same chamber without there necessarily being an abrupt change.

An air intake embodied by an air duct 74 open to the open air is preferably provided when frothing of the liquid-diluent mixture is desired. As a preference, the air duct may be positioned to intersect with the restriction. It is in this region that the venturi effect is felt and therefore that the reduction in pressure is at its maximum because of the acceleration of the fluids. The air duct may thus be positioned to intersect the duct portion 73 for example. The position of the air intake may vary and may also be sited in such a way as to lead to the diluent duct 70 or alternatively to the liquid duct 69. Thus, as a preference, the air intake is positioned such that the air is sucked in by the effect of the diluent accelerating through the restriction.

In a possible mode (not illustrated), an air pump can be connected to the air intake. The air pump can be used for creating a positive pressure in the air intake which can force air to mix with the diluent stream. Normally, the restriction of the diluent duct is enough to draw a sufficient amount of air to create bubbles in the mixture but an air pump could prove to be helpful, in particular, at elevated diluent temperatures, where steam may start forming in the device thus resulting in no sufficient air to be able to be drawn. The air pump may also be used to send air in the mixing chamber at the end of the dispensing cycle in order to empty the chamber of the mixture and/or to dry off the mixing chamber for hygiene purpose. The air intake should also be connected to atmospheric pressure at the end of the dispensing cycle to ensure that the mixing chamber can properly empty. Such atmospheric pressure balance can be obtained by an active valve placed at the higher point in the air feed system.

The mixing chamber 80 has a width of the order of at least five times, preferably at least ten or twenty times, the cross section of the duct portion 73 more or less at the exit from the meeting point. A broad chamber is preferable to a simple duct to encourage mixing and also to prevent any liquid from being sucked back into the venturi system when the device is at rest, as this could detract from the maintaining of good hygiene in the device. However, in principle, the chamber could be replaced by a duct of smaller cross section.

The chamber also allows the mixture to be decelerated and therefore avoids the mixture being expelled too abruptly and possibly causing splashing as it is delivered. For that, the chamber has for instance a bowed shape, or has the shape of an S so as to lengthen the path of the mixture and reduce the speed of the mixture.

The chamber is connected mainly to a delivery duct 85 for delivering the mixture. A siphon passage 81 may also be provided in order to completely empty the chamber because of its bowed shape, after each delivered drink cycle.

The duct preferably comprises elements 86, 87, 88 for breaking down the kinetic energy of the mixture in the duct. These elements may, for example, be several walls extending transversely to the duct and partially intersecting the flow of mixture and forcing this mixture to follow a sinuous path. These elements may also have a function of homogenizing the mixture before it is let out. Of course, other forms are possible for breaking the flow of the drink.

The metering and mixing device according to the invention also preferably comprises guide means allowing docking with the base station and, in particular, facilitating alignment of the diluent coupling and pump drive means. These guide means may, for example, be portions of surfaces 33, 34, 35, 36 through the device, for example, transversely to the parts 3A, 3B. The surfaces may, for example, be partially or completely cylindrical portions. The guide means also perform the function of supporting the weight of the package and ensure firm and stable docking. These means may of course adopt other highly varied shapes.

The parts 3A, 3B are assembled by any appropriate means such as welding, bonding or the like. In a preferred embodiment, the two parts are laser welded. The laser welding may be computer controlled and has the advantage of welding the parts together without any movement, unlike vibration welding; this improves the compliance with dimensional tolerances and the precision of the welding. For laser welding, one of the parts may be formed in a material that is more absorbent of laser energy while the other part is made of a plastic transparent to laser energy. However, other welding techniques are possible without departing from the scope of the invention, for example vibration welding.

It is preferable to provide a connecting joint 79, such as a weld, which partially or completely borders the ducts and chambers of the device. The joint is preferably perfectly sealed. However, a joint with non-welded regions may be provided in order to control the entry of air into the device.

Figure 9:
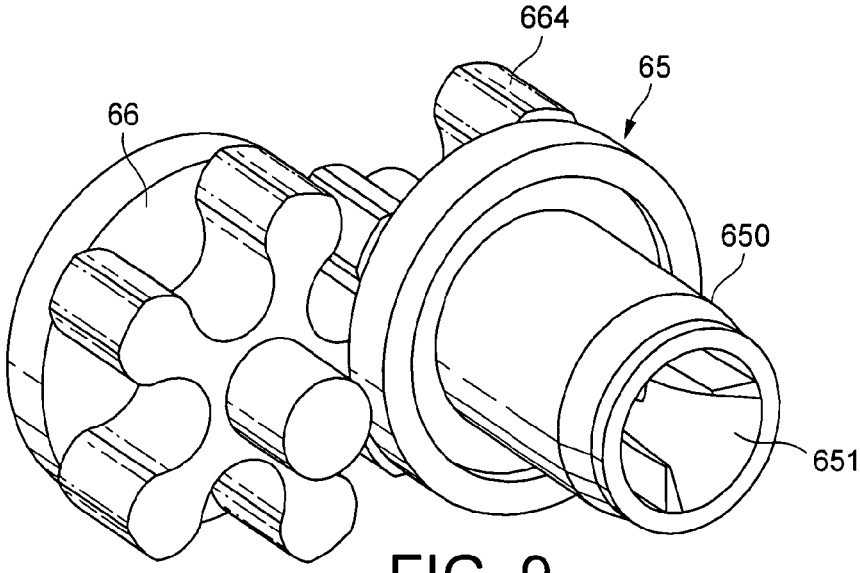
FIG. 9 depicts a perspective part view of the rotary elements of the liquid metering pump.

FIGS. 9 and 10 show a detailed depiction of the rotary elements 65, 66 of the liquid pump. In an advantageous construction, the gearing elements each have teeth 652, 660 of complementing shapes, the cross section of which has a rounded shape towards the ends with an area of restricted cross section 661 at the base of each of the teeth. Such a rounded tooth geometry makes it possible to create a closed volumetric metering region 662 which does not experience compression and transports a volume of liquid that is constant for each revolution. This configuration has the effect of reducing the effects of compression on the metered liquid and this improves the efficiency of the pump and reduces the loads on the pump. As a further preference, the outermost portion 662 of each tooth is flattened with a radius greater than the radius of the sides 663 of each tooth. In particular, the flattening of the most extreme portions 664 allows the teeth to be brought closer to the surface of the pumping chamber, thus reducing clearance and improving sealing.

It should be noted that the device can meter liquids over a wide range of viscosities. However, when the liquid is too fluid it may be necessary to add a valve to the liquid metering duct 69, or to the inlet 32, to prevent the risks of liquid leaks. The valve is configured to open under the thrust of the liquid exerted by the pump and to remain closed and sealed when the pump is switched off so as to prevent any liquid from leaking through the device.

It should also be noted that the container, if not specifically designed to be collapsible, may require to be returned to a pressure of equilibrium with the external environment by the way of a venting means. If the container is not vented, it may collapse due to pressure reduction inside it and it can break. A venting means may be a valve such a duckbill valve and the like. Another way of venting the container may be to drive the pump for several turns in the direction opposite to the metering direction. A preferred venting way is described in relation to FIGS. 15 to 17 as will be later explained in the present description.

Figure 11:
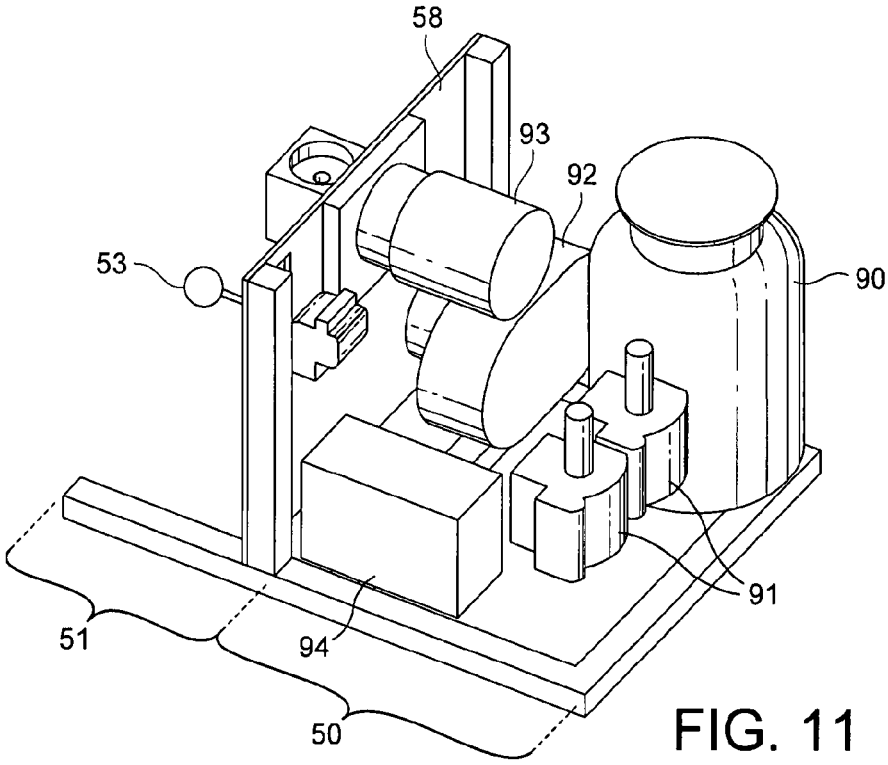
FIG. 11 depicts a schematic view of the inside of the base station.

With reference to FIGS. 1-2, 11 and 12 the system according to the invention also comprises a base station 5 forming the machine part, as opposed to the package 2. The base station comprises a technical area 50, generally internal and protected, at least in part, by a cover 55 and an interface area 51 directly accessible to the user. The interface area also offers control means 53 for controlling the delivery of a drink. The control means may be in the form of an electronic control panel (FIGS. 1 and 2) or a lever (FIG. 11).

Figure 12:
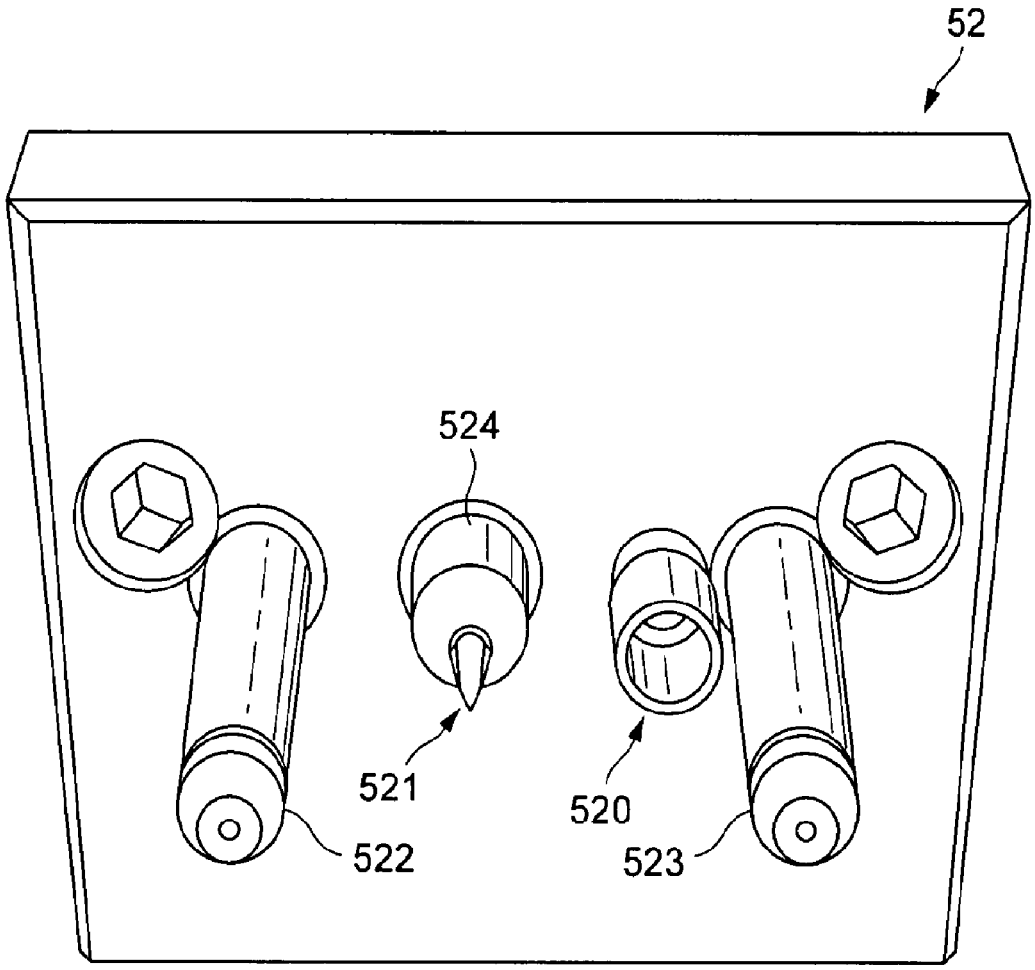
FIG. 12 depicts a detailed view of the base station coupling means.

The interface area 51 is configured to allow the docking of at least one package 2, via at least one docking station 52. Several docking stations may be provided, arranged in rows to each accept a package containing a different or the same food liquid, so that a varied choice of drink can be offered or alternatively in order to increase the system's serving capacity. As FIG. 12 shows in detail, a docking station comprises a diluent coupling means 520 and a means for coupling the drive to the metering pump 521.

The means 520 may be a portion of a tube fitted with a non-return valve the diameter of which complements the diameter of the diluent intake 71 of the metering and mixing device so as to engage therewith. Assembly may be achieved using one or more seals. The coupling means 521 is, for example, a portion of a shaft ending in a head of smaller cross section and with surfaces that complement the internal surfaces of the coupling means 651 belonging to the metering and mixing device. The head may have a pointed shape of polygonal cross section or may be star shaped, for example, offering both speed of engagement and reliability in the rotational drive of the pump. The docking station may also comprise guide means 522, 523 that complement the guide means 33, 34 of the metering and mixing device. These means 522, 523 may be simple bars or fingers to accept the surfaces of the guide means in sliding. It goes without saying that the shape of the guide means 522, 523, 33, 34 may adopt numerous forms without departing from the scope of the invention. Thus, the guide means 522, 523 of the docking station may be hollow shapes and the guide means 33, 34 may be raised.

The base station, as illustrated in FIG. 11, has a technical area 50 which combines the essential components for supplying the metering and mixing device 3 with diluent and for driving the liquid pump. For that, the base station comprises a diluent supply source, such as a reservoir of drinking water 90 connected to a water pumping system 91. The water is then transported along pipes (not featured) as far as a water temperature control system 92. Such a system may be a heating system and/or a refrigeration system allowing the water to be raised or lowered to the desired temperature before it is introduced into the metering and mixing device 3. Furthermore, the base station possesses an electric motor 93 controlled by a controller 94. The electric motor 93 comprises a drive shaft 524 which passes through the docking panel 58.

As a preference, the system according to the invention offers the possibility of varying the metering of the liquid according to the requirements via a control panel 53 featured in the interface area, thanks to a selection of buttons each of which selects a specific drinks dispensing program. In particular, the liquid:diluent dilution ratio can vary by varying the speed at which the pump is driven. When the speed is slower, the diluent flow rate for its part being kept constant by the diluent pump system 91, the liquid:diluent ratio is thus reduced, leading to the delivering of a more dilute drink. Conversely, if the liquid pump speed is higher, the concentration of the drink can be increased. Another controllable parameter may be the volume of the drink by controlling the length of time for which the diluent pump system is activated and the length of time for which the liquid pump is driven. The controller 94 thus contains all the necessary drinks programs corresponding to the choice effected via each button on the control panel 53.

The metering and mixing device or the container may also comprise a code that can be read by a reader associated with the base station 5. The code comprises information referring to the identity and/or the nature of the product and/or to parameters concerned with the activating of the diluent supply and/or liquid pump drive means. The code may, for example, be used to manage the flow rate of the liquid pump and/or of the diluent pump, contained in the base station, so as to control the liquid:diluent ratio. The code may also control the opening or closing of the air intake in order to obtain a frothy or non-frothy drink.

Figure 13:
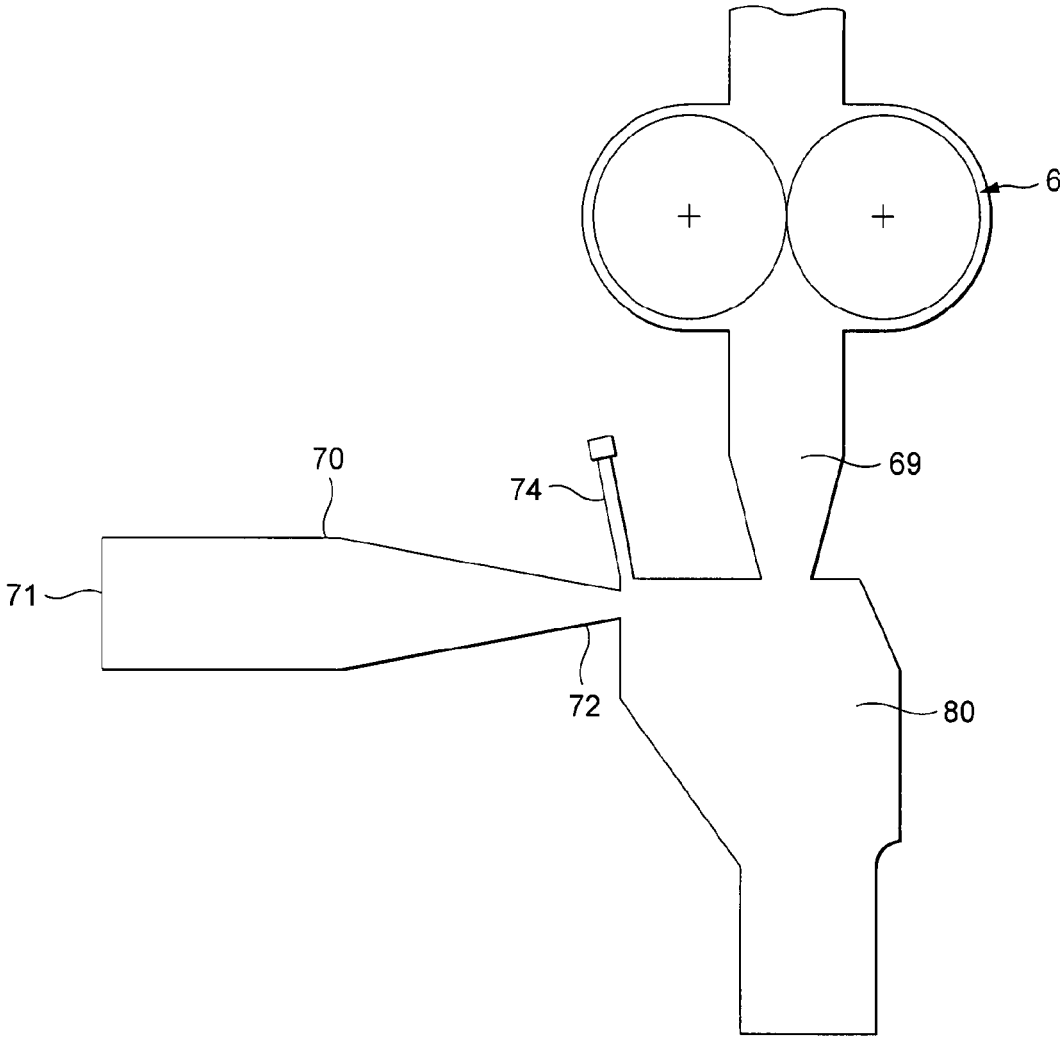
FIG. 13 depicts a schematic view of the device of an embodiment of the invention according to a different fluidic arrangement.

As illustrated in FIG. 13, the air intake or channel 74 can be placed to intersect the diluent duct 70. Therefore, it is placed before the intersection of the liquid stream and diluent stream. The problem with air channel placed after the intersection of the liquid and diluent ducts is that the air channel can become contaminated by diluted liquid which may cause bacterial growth. The problem is mostly caused by geometry and physical factors such as liquid surface tension, phase changes, etc. This air channel cannot be properly cleaned during a flushing cycle with a cleaning liquid (i.e., hot water) as the restriction causes a suction effect from the air channel to the mixing chamber that prevents the cleaning liquid from entering the air channel. Therefore, this new location ensures that no food liquid can enter the air channel. In the present example, the diluent duct 70 and the liquid metering duct 69 are not directly positioned in intersection one another but meet with the mixing chamber 80. The diluent duct 70 is nevertheless positioned in such a way that its stream is directed toward the liquid stream, i.e., in the direction of the liquid outlet or slightly below. An air intake 74 is furthermore provided in the region of the restriction 72. The diluent speed is such in that region that air is sucked in the diluent stream before the stream meets the liquid stream. Such an arrangement reduces the risk of the air intake being contaminated with the diluted product coming in the air intake by accident.

Figure 14:
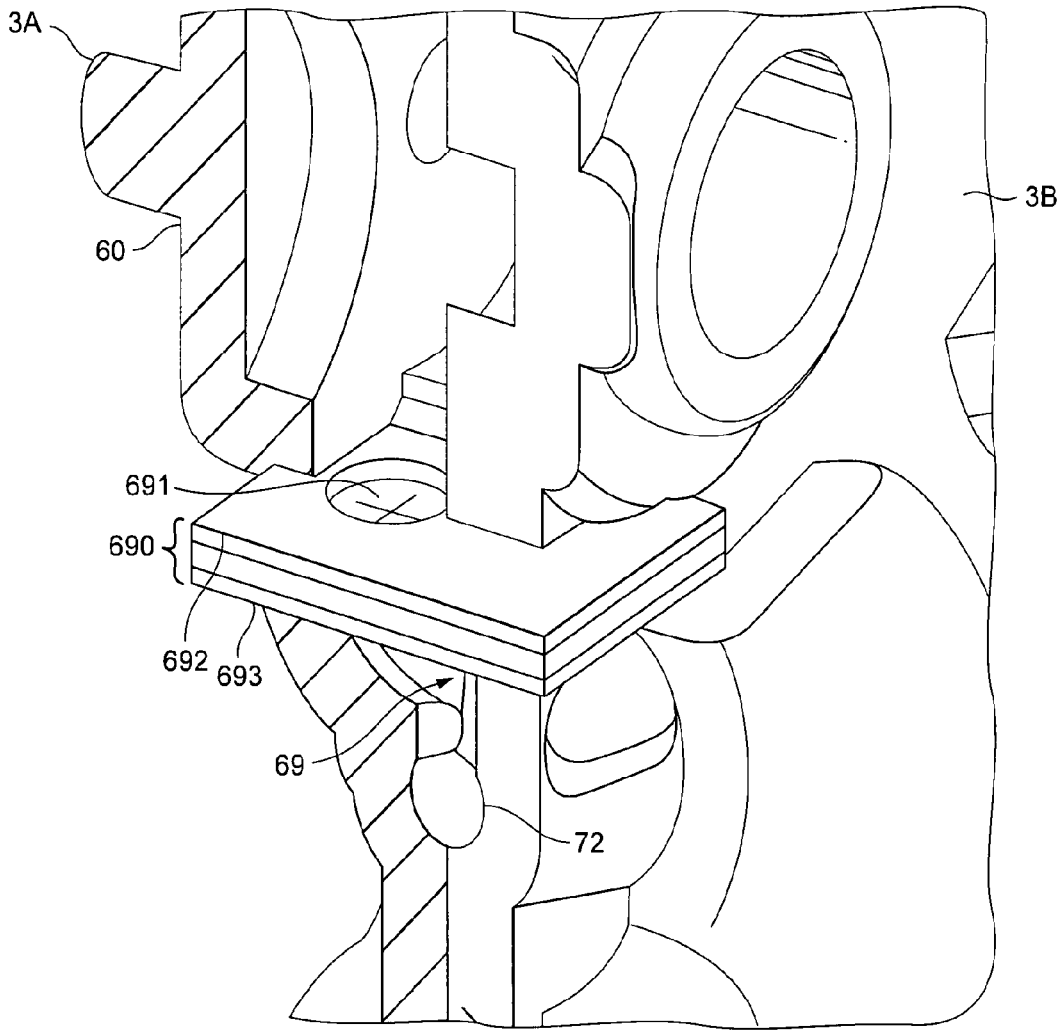
FIG. 14 depicts a detail cross sectional view of an embodiment of the device of the invention, in particular, a non-return valve that is positioned at the pump outlet to prevent liquid dripping.

In an embodiment illustrated by FIG. 14, the device comprises a barrier valve 690 placed between the metering pump 65 and the mixing chamber 80. The barrier valve 690 is a non-return valve device that opens under the pump pressure to let liquid flow toward the mixing chamber but prevents a backflow, i.e. diluent from entering into the metering pump 65 and up to the container. The valve 690 acts as a hygienic and safety barrier so that the food liquid is not contaminated before reaching the mixing (dilution) chamber. Indeed, if diluent would contact the liquid, e.g. the beverage concentrate, portion(s) of the liquid would become diluted and would achieve a higher water activity that could be prone to constitute a media for microbial growth. Therefore, the barrier valve 690 ensures that the liquid is neither diluted in the pump nor upstream of the pump. Also, since it is virtually impossible to guarantee total tightness in particular for low viscosity liquids, the valve 690 that is added e.g. in the liquid metering conduit downstream of the pump prevents liquid from dripping in the mixing chamber or at the intersection area 72. Since traces of water cannot be totally removed or dried in the intersection area 72 and the mixing chamber, if liquid drips from the pump to these areas, the diluent could contaminate the liquid therefore causing a potentially favourable ground for bacterial growth after several hours of inactivity. The valve also prevents this issue by stopping the liquid from dripping during inactivity of the device.

Finally, the barrier valve 690 also enables to reduce the rinsing cycle. In particular, the amount of rinsing fluid, i.e., hot water that is necessary to be flushed after each liquid metering can be advantageously reduced since the valve closes automatically the liquid duct 69 when the metering means is stopped. Therefore, the liquid immediately stops being dispensed in the chamber. Therefore, rinsing with hot diluent can be kept as minimal as possible, be preferably integrated as a part of the final beverage dispensing cycle and can be so much less perceptible for the user. The valve 690 can be any sort of non-return valve. The valve 690 can be as illustrated in the embodiment of FIG. 14, an elastomeric valve 690 injected in a single piece, for instance, an injected silicone valve. In this case, the valve 690 can be maintained in place along its edges being tightly inserted in a portion of slit provided in each half shell 3*a*, 3*b*.

In FIG. 14, the valve 690 comprises an elastomeric or silicone slit valve member or layer 691 maintained transversally in the liquid duct 69 by two rigid plies such as two metal plates 692, 693. The valve 690 can be inserted through slots provided through the two half-shells 3A, 3B. The slit valve member is configured so that the slits open downwardly when a fluid pressure has built up upstream the valve as a result of the pump being activated in the pump chamber 60 (pump members not shown). As soon as the pump is stopped, the valve is resilient enough to close off the outlet.

In the following it will be described with reference to FIGS. 15 to 17 how air from the ambience can flow into the container in a controlled manner.

This aspect of the invention deals with the problem that, when dispensing a liquid from an essentially closed container, the pressure in the container will decrease, thus creating a vacuum which can be detrimental to the dispensing action.

Therefore this aspect of the present invention proposes a particularly advantageous solution for compensating the liquid volume dispensed from a sealed container, such that the pressure inside the essentially sealed container is re-balanced when dispensing liquid therefrom.

Intermittently the pressure actually can be decreased, i.e. according to the invention the air compensation flow does not necessarily have to take place at the same time of the dispensing action. The pressure drop caused by a short single dispensing action usually is not a problem as long as this pressure drop does not accumulate during the course of several dispensing actions. As will be explained later on, allowing a short reduction of the pressure during dispensing and compensating later on can even have advantages.

Note that this aspect of the invention can also find application without mixing the dispensed liquid with a diluent as described with reference to FIGS. 1 to 14 but may also apply to a simply metering and dispensing a liquid without added diluent (e.g., in the application to the dispense of a "ready-to-drink" beverage for instance).

With reference to the previous FIGS. 1 to 14 it has already been described in detail that control means are provided which control the draining of liquid from a container to a dispensing outlet.

In the examples shown rotary metering means (a gear pump being only one example thereof) are used for controlling the metering, i.e. the flow of a liquid (e.g. a base liquid) from the container e.g. into a mixing chamber.

Now, with reference to FIGS. 15 to 18 a mechanical arrangement of the dispensing cap will be explained which allows a compensatory flow of air from the ambience through an airflow channel in the cap and then into the container.

As will be clear from the following detailed explanation, the compensatory flow of air through the cap is taking place in a controlled manner, e.g. especially it can be turned off and on e.g. by control means.

The compensatory flow of air into the container can be controlled regarding the timing (i.e. the time when it takes place) and/or the volume of air which is allowed to enter the container.

These control means can e.g. be electronic control means which also control the metered draining from the liquid from the container to the liquid outlet 69 and in the mixing chamber.

FIG. 15 shows the cap 3 to be attached to an opening of a container (bottle etc.). Again, reference 3A designates the front shell and reference 3B designates the rear shell of the dispensing cap device 3.

As it can particularly be seen from the detailed view in FIG. 16, a piston rod 1000 can protrude through an opening 1001 made in the centre part of the rear shell 3*b*. The piston rod 1000 is the main element of a valve which is controlled to allow or prevent the flow of air from the outside into the cap 3 and then into the attached container. Other actively controlled valve arrangements can equally be used in connection with the present invention.

As can be seen from FIG. 17, the piston rod 1000 can be transferred between a closed position (left side of FIG. 17) inhibiting air flow and an open position (right side of FIG. 17) preventing the flow of air from the outside into the cap and then into the attached container.

In the closed position as shown on the left side of FIG. 17, a conical seat 1004 of the piston rod 1000 tightly seals the opening 1001 in the rear shell 3B. In this position of the piston rod 1000 no air from the outside can enter an air flow channel 1005. The air flow channel 1005 is provided between the rear shell 3B and the front shell 3A of the cap dispensing device 3. The air flow channel 1005 can selectively provide for a fluid connection between the ambience (i.e. the exterior of the cap dispensing device 3) and the interior of a container attached to the cap dispensing device 3.

As it is shown in FIG. 18, the air flow channel 1005 is separated from the channel or inlet 32 for dispensing the liquid from a container attached to the dispensing cap 3. Separation can be improved by an air flow deflecting or protecting portion that can protrudes internally in the cavity formed by the tubular connection. In the illustrated embodiment, a protecting portion of wall 1030 is provided that at least partially covers the liquid inlet 32. This portion has openings which are preferably located on a distant side from the outlet of the air flow channel 1005. Therefore, it ensures that no air can be drawn in the liquid inlet in case the air venting would start before the pump is stopped.

The piston rod 1000 is provided with a spring biasing element 1003, which can have a spring-elastic effect due to its shape and/or its constituting material (e.g. it can be made from silicon or other rubber-elastic materials). This spring biasing element 1003 secures the piston rod 1000 in the closed position in case no external forces are applied. Again, in this spring-biased closed position of the piston rod there is no fluid communication between the exterior of the cap device 3 and the air flow channel 1005 leading to the interior of an attached container.

Guiding means 1002, such as for example three guiding longitudinal lips can be provided at the edge of the opening to guide the piston rod during the stroke through the opening 1001 in the rear shell 3B and to provide an open cross section for the air.

Control means can comprise an actuator in the machine to actively transfer the piston rod 1000 from the closed position to the open position as shown in the right figure of FIG. 17. In the open position the piston rod 1000 is actively pushed by an actuator to the right against the spring biasing force of the spring biasing member 1003. The conical seat 1004 of the piston rod is leaving its sealed seat in the opening 1001 in the rear shell 3B, such that a clearance occurs between a cylindrical element 1006 of the piston rod and the opening 1001 in the rear shell 3B, as the diameter of the cylindrical element 1006 of the piston rod 1000 is a little smaller than the inner diameter of the opening 1001. The open cross section for the air is done by the spaces between the lips.

This clearance now constitutes a fluid (air) flow communication channel between the exterior of the cap device 3 and the air flow channel 1005 such that in the position as shown in FIG. 17, right hand side, air as indicated by the arrow can flow from the outside, through the clearance between the cylindrical portion 1006 and the opening 1001 in the rear shell 3B into the air flow channel 1005 of the cap device 3 and thus into the interior of a container attached to the cap dispensing device 3.

Note in FIG. 18 that the air flow channel 1005 enters the interior of the attached container at a position which is different to the position at which the base liquid is allowed to leave the container.

Again, the transfer from the closed state to the open state of the piston rod 1000 is actively controlled, e.g. by a solenoid controlled by an Electronic Control Unit (ECU). The control unit can be part of the base station 5 as described in relation to FIGS. 1, 2 and 11. As soon as this active control into the open state stops, the piston rod will automatically return to the closed position as shown in the left hand on FIG. 17 due to the spring biasing force of the spring biasing element 1003. In other words, without an active control the compensatory air flow will stop.

Note that the air valve comprising the piston rod or comparable means can alternatively be biased in the open position and then be actively transferred into the closed position. Finally, both states (open/close) and the transfer between these states can be actively controlled by an actuator and the electronic control unit; both being part of the base station.

According to one aspect of the present invention the control means are designed such that the compensatory flow of air into the container is only allowed during periods in which no liquid is allowed to leave the container to the dispensing outlet. This has the advantage that no air bubbles generated by the compensatory air flow are re-sucked into the dispensing cap 3, in particular, in the liquid metering means, which can, in turn, generate problems with regard to a reliable metering and the reliable function of the rotary metering means (pump).

The compensatory air flow is particularly advantageous in case a non-collapsible container or a container with limited ability to collapse (e.g., semi-rigid blow-moulded plastic) is used. In these scenarios, when liquid is drained from the container by the pump for dosing and then subsequently mixing, a decrease of pressure will occur in the container thus forcing the walls of the container inwardly to the difference of the pressure between the external (atmospheric) pressure and the decreased internal pressure. As a result, when the negative pressure in the container reaches a certain value, the accuracy of the dosing decreases and finally the liquid may no longer be pumped by the metering device.

Therefore the invention provides for means for balancing the internal pressure of the container such that the container can keep or recover its form after dosing a certain volume of liquid from the container. Therefore, liquid can be dosed at pressure close to or at the atmospheric pressure, therefore, no longer forcing on the metering device.

According to the invention the turning off and on of the compensatory air flow is actively controlled e.g. by an actuator. Advantageously this turning off/on of the compensatory air flow into the container is independent from the liquid dispensing action. The independent control of the compensatory air flow vis-à-vis the draining of the liquid give the possibility that the periods when the compensatory air flow is allowed can be made separate from the period during which liquid is drained from the container.

Devices using passive vent valves for the compensatory air flow or using devices in which the enabling of the compensatory air flow is mechanically coupled to the activation of the metering of the liquid do have the problem that the compensatory air flow has to occur during the same time periods when liquid is drained from the container. This simultaneous entry of air into the container when liquid is dosed from the container by e.g. a pump has the risk of forming air bubbles entering then the dosing pump. There are three negative effects of air entering the pump:

1. The dosing becomes inaccurate because the amount of air is uncontrollable and air can be sucked into the pump so the pump feeds air instead of liquid.
2. When the valve is open to early, liquid can exit through the air compensation valve thus creating leakage in hygienic issues. Furthermore liquid tends to dry off after a while thus blocking the compensation valve.
3. The concentrate leaving the cap dispensing device can be soapy due to the incorporation of the air bubbles.

Furthermore, passive systems relying on a pure mechanical coupling between the dispensing action and the venting are more complicated when the dispensing is done using a rotary metering device such as e.g. a gear, vane or lobe pumps.

Again, according to the invention an air compensation valve is proposed that is actively controlled and especially controlled independently from the liquid draining action. Thus the air compensation valve can be actively actuated thus it is opened only during periods during which the action of the dosing pump is stopped or nearly stopped. As a result, air entering the container can no longer be re-drawn into the dispensing device.

The air compensation device (venting device) according to the invention is based on a valve member (piston rod) that it is spring biased and comprises an actively controlled portion that can be controlled by the external control device comprising an actuator (e.g. a solenoid) and an electronic control unit which sends on and off signals to actuate the actuator. The venting device can be integrated into the cap and is thus disposable together with the container, while the control device and the actuator can be a permanent part of the machine or base station.

During liquid delivery, the product is dosed from the dispensing cap device while the air compensation valve member stays closed. The pump is rotated to deliver (meter) the proper amount of liquid depending on the beverage to deliver and mix it with a diluent. During dosing, the container slightly deforms since the pressure inside the container will be lowered. As soon as the pump action is stopped, the air compensation valve will be opened actively by the controller that commands e.g. a solenoid. Air will so enter the container creating bubbling in the container. However, since the metering device is stopped, no air will be forced in the metering device.

According to the invention the air compensation (venting) action can be controlled depending on the amount of liquid dispensed from the container. Therefore the amount of air that is drawn in order to compensate for the amount of liquids can be calculated properly. To this regard, e.g. an electronic control can have a simple control function that provides a correlation between the dispense liquid volume and the venting time, i.e. the time during which compensatory air is allowed to flow into the container. The air compensation valve will remain open during a defined time period that is a calculated function of the volume of liquid which has been dispensed in a previous step.

It can be also noted that the venting device assists in preventing diluent from being drawn in the liquid metering duct or liquid outlet by balancing the pressure, i.e. removing the negative pressure in the container. The venting device acts together with the barrier valve 690 to ensure that no diluent, e.g. water, can actually enter into the metering device and above in the container which otherwise would cause a source of potential microbial contamination and growth.

FIG. 19 illustrates a simple control scheme for controlling the dosing of the liquid through the cap and venting of the container in a coordinated manner as already explained. In a first control step 1240, the electronic control unit 1200 provides a signal to start the liquid pump 1250 for pumping a predetermined volume of liquid from the container or a volume on demand. Predetermined values representative of the volume of liquid can be stored in a memory of the electronic control unit 1200. In a second step 1255, the control unit stops the pump 1250 and the control unit simultaneously or with a short lead or delay starts the solenoid type actuator 1260 to push the venting valve 1265 in the opening position. The actuator remains energized during an amount of time that corresponds to restoration of the initial pressure inside the container according to the delivered liquid volume dispensed. In possible control process, the values representing the liquid volumes, the venting time and the correlation between these parameters are stored in the memory of the control unit. In another possible control process, the venting time periods are calculated in real time by a processor of the control unit in function of the actual delivered volume of liquid. The volume of liquid can be determined by directly counting the number of rounds of the pump and/or, indirectly, by measuring the flow rate by using a flow meter, for instance.

It must be noted that there can be a certain overlapping time or, on the contrary, a delay between the pumping period and the venting period. Also, the pumping period can be run intermittently to enable venting periods between two pumping periods with or without overlap or delay times.

In one possible mode, illustrated in FIGS. 20 and 21, the device of the invention is a device for metering at least a first and second liquids and mixing the two liquids with a diluent to prepare a food product. The device is able to be connected to at least two compartments 1100, 1101. Each compartment 1100, 1101 can contain one of the first or second liquids to be mixed.

The device according to this embodiment comprises:

a first and a second liquid metering ducts 1102, 1103, at least one diluent inlet 1104, 1105 with a diluent duct, a common mixing chamber 1106 for mixing the at least two liquids with the diluent.

The at least one diluent duct can be positioned relatively to the liquid metering ducts 1102, 1103 for the diluent to intersect the liquid stream before or at the mixing chamber 1106.

A first and a second liquid pump 1107, 1108 are provided, which are part of the device, to meter respectively the first and second liquids in the first and second liquid ducts.

The device can comprise active or passive means 1109, 1110 for accelerating the speed of the diluent at the diluent inlet, in the region where the diluent meets with the first and second liquids. In the shown examples, the accelerating means are regions with restricted cross-sections. In FIG. 20, the diluent duct 1104 is common and centrally positioned relative to the two liquid metering means. The diluent flow is divided in two portions to pass through two separate restrictions 1109, 1110 to intersect the metered liquids at two separate intersection points. In FIG. 21, two separate diluent ducts 1104, 1105 are provided; one for each liquid metering means 1107, 1108. Each diluent duct is able to accelerate the diluent flow through restrictions 1109, 1110. Also, an actively controlled air inlet 1020, 1021 can be provided in intersection with at least one of the diluent flow duct or in the vicinity of the meeting point of the concentrate/diluent.

Therefore, the device may also comprise several liquid pumps each comprising a liquid duct which meets one or more diluent ducts. The advantage is then that of being able to mix several different liquids with flow rate ratios determined by each of the pumps. The pumps may be arranged either in the same plane or in a parallel plane.

One or more containers 1100, 1101 may be provided. If one container is provided, the container may comprise several chambers or compartments containing different liquids, each chamber communicating with its corresponding pump. The pumps may communicate to a common mixing chamber so that mixing occurs in the common mixing chamber. Several separate containers (each having a liquid compartment) may be provided that are attached to a common device as mentioned.

Thus, the preparation of a drink may also comprise two or more liquid components which have to be kept separate for reasons of stability, shelf life and/or beverage customization. For example, the liquid components may comprise a base of concentrate on the one hand and a flavouring, distillate or aroma on the other, thus metered by different pumps to reconstitute a flavoured drink or a drink with a better flavour. The pumps are set up to deliver the liquid components in the mixing chamber at a predetermined ratio of the first and second liquid components. A first component base of concentrate can be: coffee or tea. A second component can be: a coffee or tea distillate or aroma or another additive. In that mode, the coffee or tea base concentrate can be substantially free of coffee aroma. The aroma can be stripped off and then collect during coffee or tea concentration processing. In another possible mode, the first component may also be a coffee or tea concentrate and the second component can be a liquid whitener. Selective dispensing of the first and second components can be commanded to form a whitened or non-whitened drink and/or a frothed or non-frothed drink. A frothed drink can be delivered by controlling the amount of air in at least one of the It is also possible to provide a separate diluent duct for each liquid duct. Therefore, each diluent duct can meet with each liquid duct at a different intersection point (see FIGS. 20 and 21). A means for accelerating the flow of diluent 1109, 1110 can be placed before each intersection point with the first and second liquids. The mixing chamber can be placed downstream of the two different intersection points.

The invention also extends to the field of the preparation of non-food products. For example, the invention may be used in the field of the dispensing of products which come in the form of liquids that can be diluted, such as washing powders, soaps, detergents or other similar products. Therefore, the invention also relates to a device for dispensing a non-food and non-nutritional liquid from a container comprising the above described features and advantages.

The invention claimed is:

1. A device for dispensing a liquid from a container comprising:

an inlet for the liquid from the container and a liquid outlet, control means provided which control metering of the liquid from the container to the liquid outlet and control a flow of air into the container during at least a period in which no liquid is allowed to leave the container and flow through the liquid outlet, an inlet for a diluent, a mixing chamber for mixing a second liquid with the diluent and the liquid coming from the liquid outlet, and a dispensing outlet for dispensing a mixture of the liquid and the diluent.

2. A device for dispensing a liquid from a container comprising:

an inlet for the liquid from the container and a liquid outlet, and control means provided which control metering of the liquid from the container to the liquid outlet and control a flow of air into the container during at least a period in which no liquid is allowed to leave the container and flow through the liquid outlet, wherein the control means comprise a valve member controlling a flow of air into the device and to the container, wherein the control means comprise a pump for metering the liquid from the container, and wherein the pump is a rotary positive displacement pump.

3. A device for dispensing a liquid from a container comprising:

an inlet for the liquid from the container and a liquid outlet, control means provided which control metering of the liquid from the container to the liquid outlet and control a flow of air into the container during at least a period in which no liquid is allowed to leave the container and flow through the liquid outlet, wherein the control means comprise a valve member controlling a flow of air into the device and to the container, and wherein the control means comprise a pump for metering the liquid from the container, and a cap comprising two half-shells assembled one another and configured to encompass the pump and the valve member and to define a contour of the mixing chamber.

4. The device according to claim 3, wherein an actuating part of the valve member and connecting part of the pump are positioned on the same half shell.

5. The device according to claim 4, comprising at least one referential support means intended for a removable connection of the cap to a docking station of the device.

6. The device according to claim 5, wherein the docking station comprises:

an electrical motor, a drive shaft and a drive connector designed to removably connect to the connecting part of the pump, an actuator configured to selectively engage the actuating part of the valve member, and at least one guiding means that is complementarily engaging the guiding means of the cap.

7. A device for dispensing a liquid from a container, the device comprising:

an inlet for the liquid from the container, a liquid outlet, control means for actively controlling a flow of air into the container as a function of a volume of liquid dispensed, an inlet for a diluent, a mixing chamber for mixing a second liquid with the diluent and the liquid coming from the liquid outlet, and a dispensing outlet for dispensing a mixture of the liquid and the diluent.

8. A device for dispensing a liquid from a container, the device comprising:

an inlet for the liquid from the container, a liquid outlet, and control means for actively controlling the flow of air into the container as a function of a volume of liquid dispensed, wherein the control means comprise a valve member controlling a flow of air into the device and to the container, wherein the control means comprise a pump for metering the liquid from the container, and wherein the pump is a rotary positive displacement pump.

* * * * *